US009897310B2

(12) United States Patent
Ahmed et al.

(10) Patent No.: US 9,897,310 B2
(45) Date of Patent: Feb. 20, 2018

(54) EFFERVESCENT ATOMIZER WITH GAS INJECTION AT REDUCED PRESSURES

(71) Applicants: Mudassir Ahmed, Risalpur (PK); Jehanzeb Masud, Islamabad (PK)

(72) Inventors: Mudassir Ahmed, Risalpur (PK); Jehanzeb Masud, Islamabad (PK)

( * ) Notice: Subject to any disclaimer, the term of this patent is extended or adjusted under 35 U.S.C. 154(b) by 78 days.

(21) Appl. No.: 14/699,855

(22) Filed: Apr. 29, 2015

(65) Prior Publication Data

US 2016/0319780 A1 Nov. 3, 2016

(51) Int. Cl.

| | |
|---|---|
| ***F02M 31/06*** | (2006.01) |
| ***F23D 11/10*** | (2006.01) |
| ***F23R 3/32*** | (2006.01) |
| *F02M 43/04* | (2006.01) |

(52) U.S. Cl.

CPC ..... *F23D 11/10* (2013.01); *F23R 3/32* (2013.01); *F02M 43/04* (2013.01)

(58) Field of Classification Search

CPC ..... F02B 23/101; F02B 23/0621; F02B 7/02; F02B 23/0624; F02B 23/0651; F02B 69/02; F02B 17/005; F02B 1/08; F02B 2023/108; F02B 2275/40; F02D 2041/389; F02D 19/0694; F02D 41/0027; F02M 63/0225; F02M 37/0064; F02M 43/04

USPC ..... 123/294, 304, 305, 445, 446, 531

See application file for complete search history.

(56) References Cited

U.S. PATENT DOCUMENTS

| | | | | |
|---|---|---|---|---|
| 4,103,827 | A * | 8/1978 | Kumazawa | B01F 5/20 239/427 |
| 5,884,611 | A * | 3/1999 | Tarr | F02M 45/086 123/531 |
| 6,021,635 | A * | 2/2000 | Gaag | F23R 3/36 239/400 |
| 7,322,325 | B1 * | 1/2008 | Mueller | F01L 1/181 123/90.15 |
| 7,377,372 | B2 * | 5/2008 | Wallen | B62K 25/08 188/285 |
| 8,322,325 | B2 * | 12/2012 | Rogak | F02D 19/0647 123/304 |
| 8,377,372 | B2 * | 2/2013 | Gautam | C21C 5/4606 266/225 |
| 8,955,470 | B2 * | 2/2015 | Kudoh | A61L 9/14 123/25 E |
| 8,997,720 | B2 * | 4/2015 | Brown | F02M 63/029 123/525 |
| 2004/0025832 | A1 * | 2/2004 | Baasch | F02M 25/00 123/304 |
| 2006/0260317 | A1 * | 11/2006 | Prociw | F02C 7/222 60/739 |
| 2010/0199948 | A1 * | 8/2010 | Rogak | F02D 19/0647 123/304 |

(Continued)

*Primary Examiner* — Long T Tran
(74) *Attorney, Agent, or Firm* — Sarfaraz K. Niazi

(57) ABSTRACT

An injector model for atomization of liquid fuel using a low pressure atomized gas. The model is focused to mix a volume of liquid fuel with a volume of corresponding atomizing gas to obtain a pressurized liquid fuel-gas mixture. This liquid-gas mixture is ejected through a discharge orifice into a lower combustion chamber pressure, as a result of which the liquid fuel breaks up into ligaments. The atomized gas emerges from the liquid fuel-gas mixture as a result of pressure jump and further enhances this break-up of liquid fuel into smaller droplets and promotes combustion of these droplets in the chamber.

7 Claims, 3 Drawing Sheets

1- Primary Nozzle 2- Gas Injection hole 3- Secondary Nozzle 4- Mixing Chamber
5- Diffuser Section 6- Viscous Flow Nozzle 7- Orifice

(56) References Cited

U.S. PATENT DOCUMENTS

2013/0306181 A1* 11/2013 Mitchell ..... F23L 15/04
137/888
2015/0211461 A1* 7/2015 Shirk ..... F02M 61/1833
239/557

* cited by examiner

1- Primary Nozzle
2- Gas Injection hole
3- Secondary Nozzle
4- Mixing Chamber
5- Diffuser Section
6- Viscous Flow Nozzle
7- Orifice 1- Primary Nozzle
2- Gas Injection hole
3- Secondary Nozzle
4- Mixing Chamber
5- Diffuser Section
6- Viscous Flow Nozzle
7- Orifice

EFFERVESCENT ATOMIZER WITH GAS INJECTION AT REDUCED PRESSURES

BACKGROUND OF THE INVENTION

The invention relates generally to a method to enhance atomization of liquid fuel for combustion. In particular, the atomization is increased by pre-mixing an atomizing gas into the liquid fuel before it is ejected into the combustion chamber.

The design of this invention may be used to the advantage in internal combustion engines, and especially jet engines, as well as any other reciprocating engine, furnace, turbine, or combustor of liquid fuel where the atomization of liquid fuel is desired before its combustion.

Modern day aircraft engines also require efficient fuel burning inside the combustion chamber to convert this energy into thrust and produce less toxic emissions. Typically these engines use some sort of high pressurized fuel injectors to spray fuel into the combustion air. High injection pressures and high momentum air flows are required to generate small fuel drops and homogenous mixtures. Thus the fuel, after breaking up and mixing with atomizing gas, forms a fine spray pattern as it is discharged into the combustion chamber.

As more and more stringent rules are imposed on emissions regulations, efficient atomization of fuel is necessary to produce combustion with required levels of emissions. One key measurable parameter for spray quality is the Sauter Mean Diameter (SMD) of the spray droplets, with respect to which the smaller the SMD, the better the spray quality. Unfortunately, to achieve a spray quality of required SMD the current liquid fuel injection systems demand extremely high atomizing gas pressures so that liquid fuel is atomized to the required level. One such technique is being utilized in the design of an effervescent atomizer, which works on the principle stated above.

In effervescent atomizers, first introduced in late 1980s, volatile liquid fuels are atomized into a finely divided spray of small droplets due to injection of high pressurized gas upstream of the discharge orifice. Much finer spray patterns are produced by such atomizers than compared with other conventional atomizers. The atomization of fuel to produce homogenous mixture is important for further combustion process efficiency. The required efficiency of the combustion process in engines of the present day has assumed greater importance than in the past due to increased environmental concerns and more stringent regulations on exhaust pollutants due to inefficient combustion reactions.

The advantages of effervescent atomizers as compared to conventional external or internal atomizers are listed for consideration: (a) Effervescent atomizers have the ability to produce relatively good atomization at much lower gas injection pressures as compared to other atomizers, (b) In comparison to other methods of atomization, much smaller drop sizes are obtained for a given gas injection pressure, (c) The atomizing gas is injected into the liquid at relatively lower velocity to form a bubbly mixture than those employed in most other forms of atomization, (d) For a fixed flow rate, effervescent atomizer gives the luxury of having a larger exit orifice diameter as compared to other atomizers. This prevents orifice erosion in case of liquids having solid suspension. Also this advantage facilitates fabrication and manufacturing processes, (e) Spray characteristics are independent of the fluid properties used. SMD, which is the main performance criteria, is the function of internal design and geometry, (f) Effervescent atomizer has a very durable and simple design. It requires nearly no maintenance and can be operated at low cost The gas supply pressure has to be kept at slightly higher pressure than the fluid for injection. It is because of the presence of this pressure difference, the atomizing gas is able to flow through the perforations of the central tube and forms a bubbly flow in the liquid stream. Due to this, a two phase homogenous bubbly mixture is formed just upstream of the discharge orifice. The requirement demands presence of a gas pressurization system (probably a centrifugal pump) for a constant supply to the atomizer. Such a pressurized gas system requires considerable space in any of its application.

Thus, there exists a need to re-evaluate the existing effervescent atomizer design in a way that it utilizes all the advantages of a twin fluid internal mixed atomizer, to produce the desired degree of atomization, and at the same time overcome its inherent shortcoming of operating at higher injection pressure of atomizing gas as compared to the liquid fuel.

BRIEF SUMMARY OF THE INVENTION

The above discussed drawback and deficiency of the prior art (effervescent atomizer) are overcome and alleviated by a new atomizer design which can produce fine liquid fuel drops and homogenous fuel gas mixtures for combustion thereof, particularly in an internal combustion engine.

Present invention, exploits the fluid mechanics principle of entrainment of atomizing gas into the liquid fuel at a pressure much lower than that of the liquid. Due to this entrainment of gas, a two phase mixture is formed similar to an effervescent atomizer. An engineering application of this principle lies in the design of Ejector or Jet pumps.

Ejector pump is a device in which the kinetic energy of one fluid stream (primary or driving fluid) is used to drive another fluid stream (secondary or induced fluid). The secondary fluid is entrained due to the viscous friction at the primary jet periphery and turbulent mixing of both the fluids takes place inside the ejector pump. Therefore, ejector pump principle was utilized for the current invention with few necessary alterations in the design, and is to be used as an effervescent atomizer to overcome its shortcoming.

The foregoing and other aspects will become apparent from the following detailed description of the invention when considered in conjunction with the accompanying drawing figures.

DETAILED DESCRIPTION OF THE INVENTION

The liquid fuel of an internal combustion engine must be mixed with an atomizing gas so that it can be quickly and cleanly burned to produce power. This invention provides a new means to more efficiently dissociate the liquid fuel into ligaments and drops to enhance evaporation and mixing by using atomizing gas at pressures lower than that of the liquid fuel.

Figure 1:
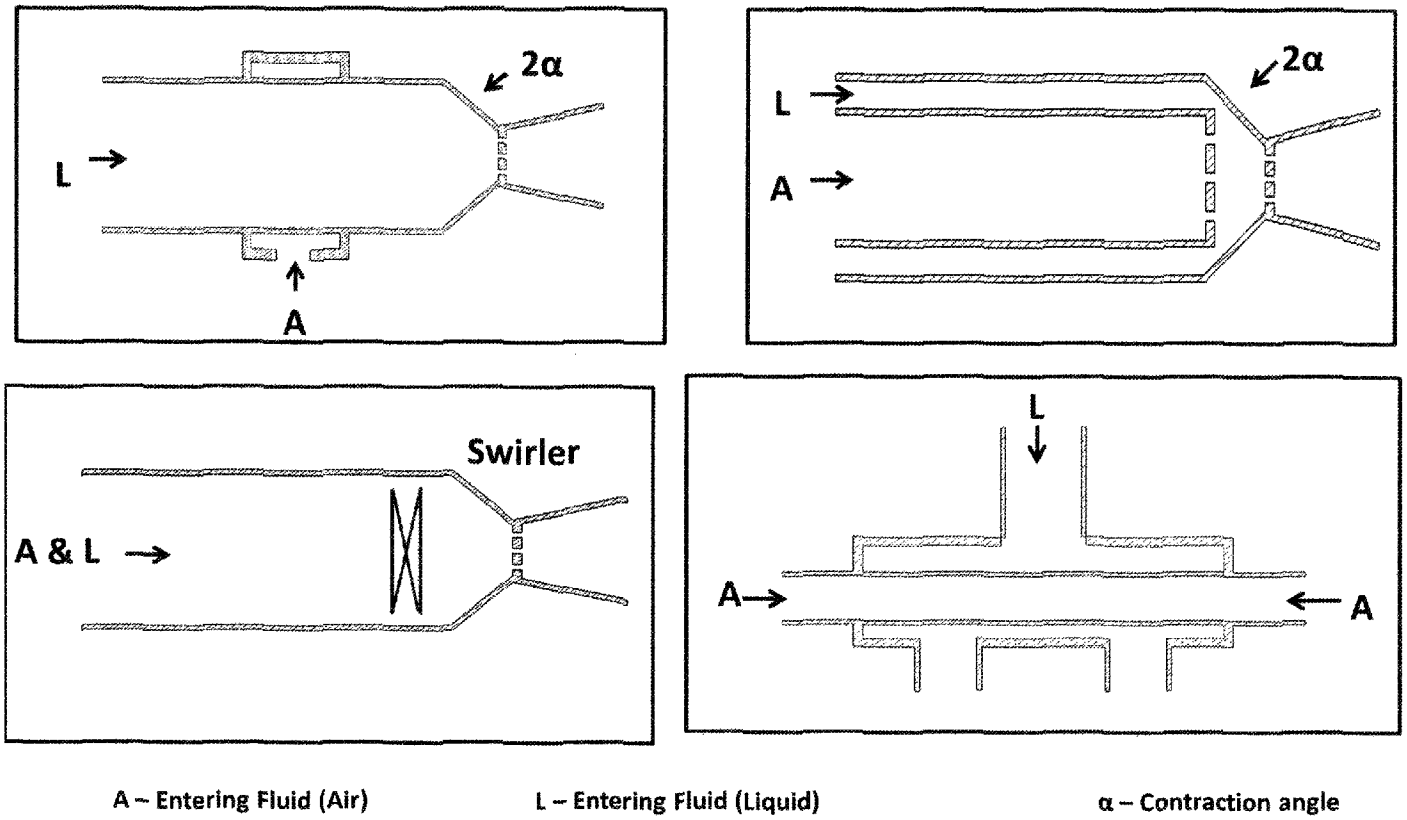
FIG. 1 is a cross sectional view of the parts of typical prior art effervescent atomizers.

Turning now to the drawings wherein like parts are referred to by the same number throughout the several views, FIG. 1 is a schematic representation of a prior art effervescent atomizer, that is used to inject atomized fuel into the combustion chamber in the form of a homogenous mixture.

Generally, in FIG. 1, atomizing gas is supplied from conventional centrifugal pump assembly at a pressure higher than that of the liquid fuel and subsequently liquid fuel is also supplied through another pressurizing system. The gas may be any suitable atomizing gas that can be dissolvable in the liquid fuel, such as but not limited to, a non-polar gas soluble with a hydrocarbon based fuel. However, for purposes of describing an exemplary embodiment of the invention, the gas mixed with the hydrocarbon based fuel is a non-polar gas, such as, but not limited to NO, $H_2$, $O_2$, $N_2$, He and Ar. The gas supply system includes the requisite valves and other conventional flow regulating devices and mechanisms that are adapted to ensure the correct volume of atomizing gas and fuel to the atomizer. Such valves and flow control devices are well known to one skilled in the art and therefore further description of these devices is not required.

The fuel that is mixed with the atomizing gas may be any suitable combustible fuel such as but not limited to fuel oil, gasoline or diesel fuel. The fuel supply system includes the requisite valves and other conventional flow regulating devices and mechanisms that are adapted to ensure the correct volume of liquid fuel to the atomizer. Such valves and flow control devices are well known to one skilled in the art and therefore do not need to be discussed in further detail hereinafter.

Figure 2:
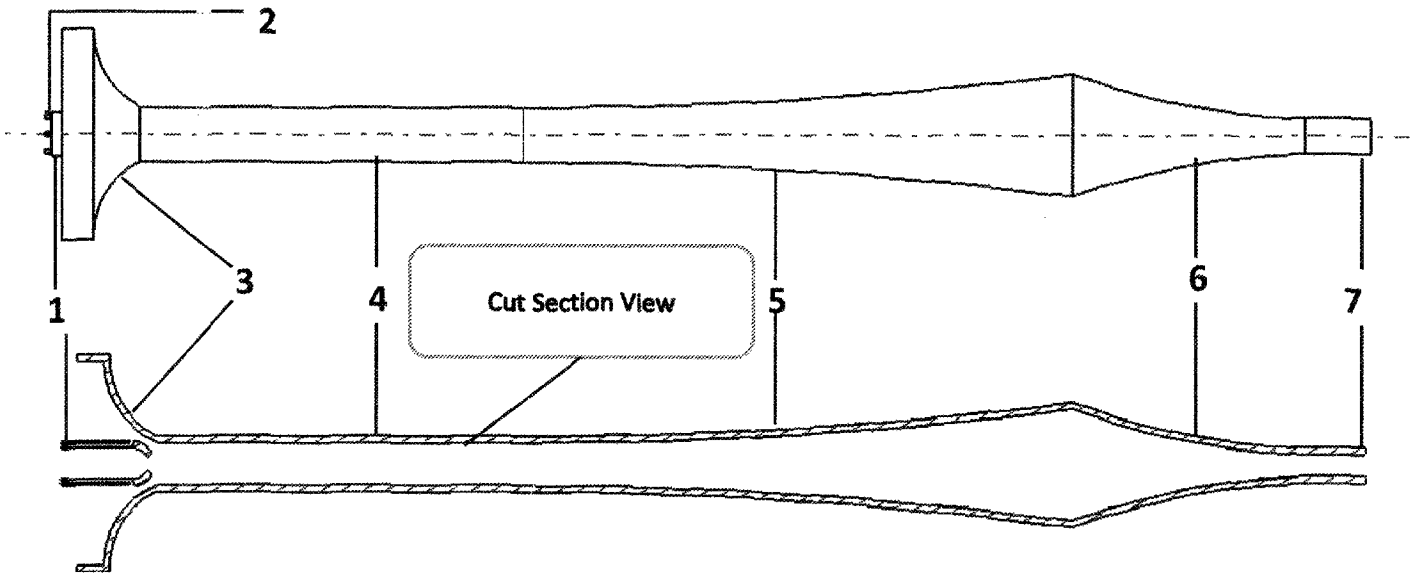
FIG. 2 is a cross sectional view of effervescent atomizer of the present invention.
Figure 3:
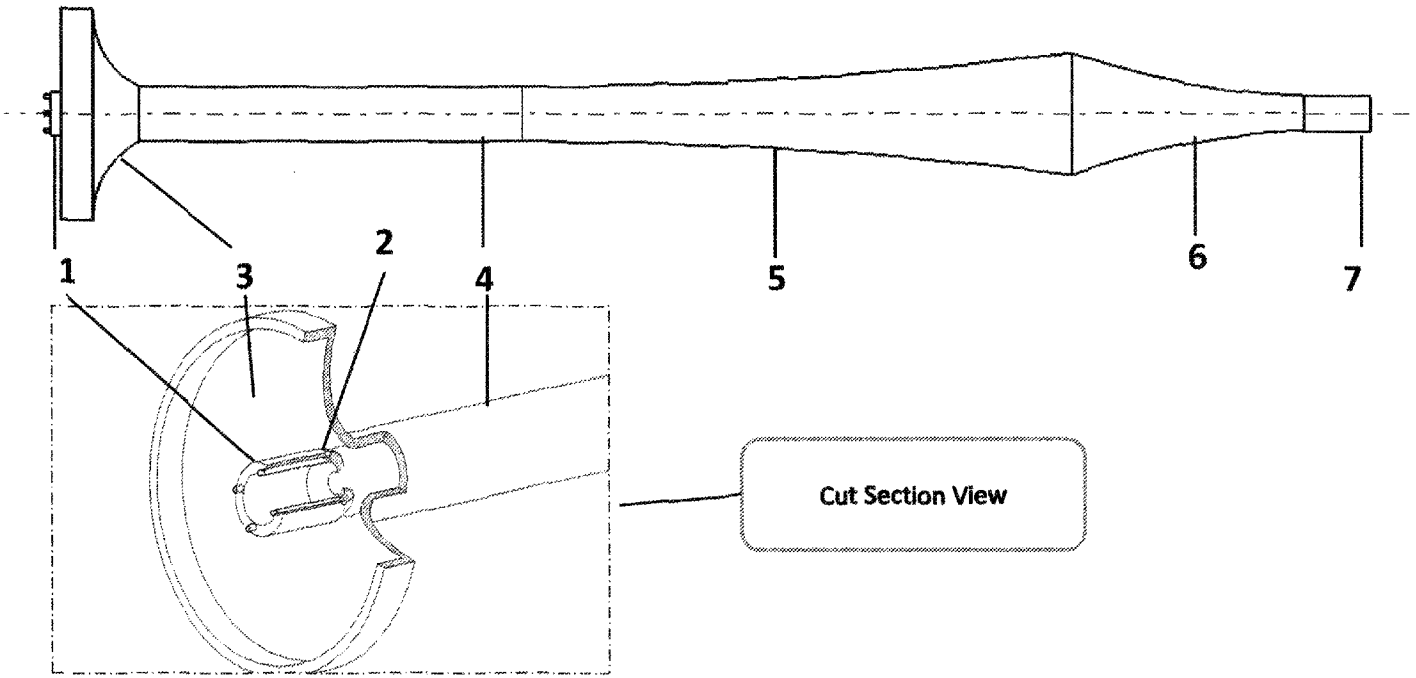
FIG. 3 is a cross-sectional view of the effervescent atomizer of the present invention.

Turning now to FIG. 2 and FIG. 3, which is an exemplary model for achieving liquid fuel atomization at lower gas injection pressures unlike the conventional effervescent model. The proposed model has a primary nozzle 1, from where liquid fuel enters. Entertainment of atomizing gas occurs through the gas injection holes 2 on the outside periphery of the secondary nozzle 3 along with liquid fuel. It also has a Mixing Chamber 4, where both the primary and secondary fluids mix with each other and complete momentum transfer occurs, and then it has a diffuser section 5 in which a homogenous fuel-gas mixture is formed. A viscous flow nozzle 6 is also integrated at the exit of the diffuser section for final discharge of the fuel-gas mixture into fine spray pattern for combustion through a orifice 7.

In the primary nozzle 1, a high-pressure fuel with very low velocity at the primary inlet is accelerated to high velocity jet through a converging nozzle. The supply pressure at the inlet is partly converted to the jet momentum at the nozzle exit according to the Bernoulli equation. The high velocity, low static pressure primary jet induces a secondary flow from the suction port and accelerates it in the direction of the driving jet.

Secondary nozzle 3 helps in entrainment of the atomizing gas along with liquid fuel into the mixing chamber. The atomizing gas is aerated into the secondary stream of liquid fuel through the gas injection holes 2. The secondary stream may be input at various angles to the primary stream, depending on the application. The high velocity primary stream at the primary nozzle exit produces a region of low pressure which subsequently entrains the secondary stream and increases its velocity.

The most important component in the proposed model that effectively characterizes the device is the mixing chamber. This is where the primary-secondary turbulent mixing takes place.

After complete mixing and momentum exchange inside the mixing chamber the static pressure of the mixed stream is generally low. In order to recover the pressure, a divergent section (diffuser) 4 is attached at the end of the mixing chamber. The diffuser reduces the velocity of the mixed stream and transforms it to static pressure.

The viscous flow nozzle 5 functions as an exit orifice similar to a conventional effervescent atomizer so that the homogenous fuel-gas mixture is discharged for combustion. When the atomized spray emerges from the orifice for combustion 7, the liquid fuel and gas mixture droplets experience a sudden pressure drop. This reduction of pressure allows the gas to expand violently out of the mixture, thus further breaking up the droplets of fuel atomized by the atomizer.

In summary, a significant quantity of gas is introduced into the fuel through its injection holes near to the secondary nozzle outlet. This atomizing gas along with the liquid fuel is aerated by the momentum exchange of the liquid fuel, which is at a higher pressure, from the primary nozzle. The two streams then combine inside a mixing chamber where energy transfer takes place. This low pressure liquid-gas mixture enters into the diffuser section where its velocity head is converted into pressure head. The mixture then passes through a contraction nozzle for final exit of pressurized fuel-gas homogenous mixture in the form of a jet. The sudden pressure drop at the discharge orifice permits the gas entrained in the liquid fuel to expand rapidly. This expansion of gas further breaks up the fuel droplets and result in a finer mist that contributes to the creation of a more homogenous mixture.

Thus, one skilled in the pertinent art will recognize that one key to this invention is the injection of gas at lower pressures as that of the liquid fuel. The precise location of the gas injection holes is the basic feature that distinguishes this invention from the conventional effervescent atomizer design. It is due to this technique the atomizing gas is able to entrain into the liquid fuel at much reduced pressures. The proposed location and number of gas injection holes, as shown in FIG. 3, are one just example of an infinite combinations. However, the uniqueness of this invention/design lies in its ability to entrain the atomizing gas at reduced pressures unlike current effervescent atomizer designs.

The invention disclosed hereinabove, addresses the major design drawback in case of an effervescent atomizer. The limitation lies in the use of atomizing gas at pressure higher to that of the liquid fuel. The present invention overcomes this design limitation and ensures gas entrainment at lower pressure subjected to careful positioning of the gas injection holes in the secondary nozzle. Due to which combustion is achieved with greater efficiency and stability than with conventional atomizers by producing finer droplets of fuel after discharge from the exit orifice.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fuel injection device for atomization of a liquid fuel with a gas comprising:

a primary nozzle that serves as an input for the said liquid fuel, having an inlet passage for the said fuel and an exit for the said fuel;

a secondary nozzle concentric with the primary nozzle and surrounding the primary nozzle, having an input for the said liquid fuel, further having an inlet passage for the said fuel, wherein the diameter of the inlet of secondary nozzle is greater than the diameter of the inlet of primary nozzle, and an exit for the said fuel;

a circular shaped mixing tube, arranged downstream of said secondary nozzle having a first end connected to said secondary nozzle and a second end opposing said first end, serves as a collector for both the liquid fuel coming from the primary and secondary nozzles exit, and converts it into a mixed fluid, a diverging diffuser section, arranged downstream of the said mixing tube having first end connected to the second opposing end of the said mixing tube and second end opposing the first end, collects the mixed fluid from the mixing tube;

a viscous flow nozzle, arranged downstream of the said diffuser having the first end connected to the second end of the said diffuser and a free end opposing the first end, accelerates the incoming mixed fluid from the diffuser to decrease pressure and subsequently ejects the mixed fluid in the form small droplets from said free end;

a single or multiple injection holes on the primary nozzle, serves as an outlet for the said gas into the liquid fuel for atomization.

2. The fuel injection device of claim 1, wherein the primary nozzle is placed inside the secondary nozzle and aligned with its axis of symmetry.

3. The fuel injection device of claim 1, wherein the exit of the primary nozzle lies in the same plane of secondary nozzle exit.

4. The fuel injection device of claim 1, wherein the outlet of injection holes are placed near to the exit of the primary nozzle so as to allow the entrainment of the said gas under the action of localized low pressure of the liquid fuel inside the secondary nozzle.

5. The fuel injection device of claim 4, further comprising an interior narrow passage disposed within the primary nozzle into which the gas is deliverable from a gas supply line to the exit of injection holes.

6. The fuel injection device of claim 1; wherein the liquid fuel is a hydrocarbon based fuel and the gas is one of NO, H, H2, $N^2$, He and Ar.

7. The fuel injection device of claim 1; wherein the liquid fuel is diesel fuel.

* * * * *